US007731160B2

(12) United States Patent
Terrels et al.

(10) Patent No.: US 7,731,160 B2
(45) Date of Patent: Jun. 8, 2010

(54) POST AND RAILING ASSEMBLY WITH SUPPORT BRACKET COVERS

(75) Inventors: Christopher J. Terrels, Ocean View, NJ (US); Christopher Michael Schnieder, Mays Landing, NJ (US); Jason Michael Werner, Ocean City, NJ (US)

(73) Assignee: Railing Dynamics, Inc., Egg Harbor Township, NJ (US)

( * ) Notice: Subject to any disclaimer, the term of this patent is extended or adjusted under 35 U.S.C. 154(b) by 0 days.

(21) Appl. No.: 12/236,790

(22) Filed: Sep. 24, 2008

(65) Prior Publication Data

US 2009/0114895 A1 May 7, 2009

Related U.S. Application Data

(60) Provisional application No. 60/995,911, filed on Sep. 28, 2007.

(51) Int. Cl.
*E04H 17/00* (2006.01)

(52) U.S. Cl. ..... 256/65.06; 256/65.03

(58) Field of Classification Search ..... 256/19, 256/21, 59, 65.01–65.06, 66
See application file for complete search history.

(56) References Cited

U.S. PATENT DOCUMENTS

| | | | | |
|---|---|---|---|---|
| 2,242,427 | A | 5/1941 | Heanue | |
| 2,316,035 | A | 4/1943 | Westrope | |
| 2,703,724 | A | 3/1955 | Der Yuen et al. | |
| 3,287,780 | A * | 11/1966 | Cooperberg | 24/421 |
| 3,385,567 | A * | 5/1968 | Case et al. | 256/24 |
| 3,482,819 | A | 12/1969 | Leurent | |
| 3,736,834 | A | 6/1973 | MacDonald | |
| 3,886,710 | A | 6/1975 | Krause et al. | |
| 3,915,434 | A | 10/1975 | Lister | |
| 3,921,960 | A | 11/1975 | Bright | |
| 3,977,800 | A | 8/1976 | Cassel | |
| 4,027,452 | A | 6/1977 | Donnell | |
| 4,102,529 | A | 7/1978 | Neblung et al. | |
| 4,108,422 | A | 8/1978 | Fleischmann et al. | |
| 4,114,861 | A * | 9/1978 | Long | 256/67 |
| 4,123,863 | A | 11/1978 | Becker | |

(Continued)

FOREIGN PATENT DOCUMENTS

CA 1 213 767 11/1986

(Continued)

OTHER PUBLICATIONS

Kroy Building Products, Inc., Picket Fence Designs, Copyright 1997; website: www.kroybp.com.

(Continued)

*Primary Examiner*—Daniel P Stodola
*Assistant Examiner*—Nahid Amiri
(74) *Attorney, Agent, or Firm*—RatnerPrestia

(57) ABSTRACT

A railing mounting assembly includes a U-shaped bracket having a pair of sidewalls and a bottom wall, the bottom wall comprising a pair of platform portions for supporting a railing, and a pair of recessed portions separated from one another by a channel, and a trim cover attached around the bracket, the trim cover having a slit and at least one locking member projecting through the channel of the U-shaped bracket.

10 Claims, 20 Drawing Sheets

U.S. PATENT DOCUMENTS 4,127,974 A 12/1978 Wendt
4,150,517 A 4/1979 Warner, Sr.
4,150,907 A 4/1979 Thurnauer
4,156,272 A 5/1979 Wandler
4,160,052 A 7/1979 Krysiak et al.
4,187,649 A 2/1980 Chaffee
4,296,587 A 10/1981 Berdan
4,333,288 A 6/1982 Coombs
4,344,719 A 8/1982 Thom
4,452,138 A 6/1984 Bubley et al.
4,477,059 A 10/1984 Willis
4,485,604 A 12/1984 Palamara et al.
4,512,127 A 4/1985 Attaway
4,569,171 A 2/1986 Kuhr et al.
4,621,471 A 11/1986 Kuhr et al.
4,642,957 A 2/1987 Edwards
4,683,634 A 8/1987 Cole
4,738,069 A 4/1988 Williams
4,958,807 A 9/1990 Wylie
5,040,456 A 8/1991 Hayes
5,061,000 A 10/1991 Haugen et al.
5,179,811 A 1/1993 Walker et al.
5,193,786 A 3/1993 Guenther
5,335,471 A 8/1994 Kupiec
5,370,368 A 12/1994 Terrels
5,398,469 A 3/1995 Logan
5,457,923 A 10/1995 Logan et al.
5,516,225 A 5/1996 Kyols
5,547,169 A * 8/1996 Russell ..... 256/67
5,560,170 A 10/1996 Ganser et al.
5,575,580 A 11/1996 Parrish
5,625,992 A 5/1997 Strick et al.
5,647,184 A 7/1997 Davis
5,690,237 A 11/1997 Marzec
5,788,224 A 8/1998 Platt
5,803,527 A 9/1998 Fujiya
5,819,491 A 10/1998 Davis
5,827,029 A 10/1998 Denman
5,838,534 A 11/1998 Yang
5,873,671 A * 2/1999 West ..... 403/232.1
D410,753 S 6/1999 Davis
5,941,033 A 8/1999 Adams
5,956,920 A 9/1999 Davis
D415,287 S 10/1999 Davis
5,966,891 A 10/1999 Fagan et al.
6,030,020 A 2/2000 Malm
6,053,481 A * 4/2000 Scheide ..... 256/65.06
6,076,329 A 6/2000 Thomson
6,115,982 A 9/2000 Lindenberg
6,141,928 A 11/2000 Platt
6,148,883 A 11/2000 Wilson
6,176,637 B1 1/2001 Hatlan et al.
6,199,340 B1 3/2001 Davis
6,203,233 B1 3/2001 Stanley
6,212,835 B1 4/2001 Schiedegger et al.
6,213,452 B1 4/2001 Pettit et al.
6,216,407 B1 4/2001 LeBlanc
6,216,413 B1 4/2001 Lapointe
6,223,486 B1 5/2001 Dunham
6,226,950 B1 5/2001 Davis
6,257,557 B1 7/2001 Anderson et al.
6,286,161 B1 9/2001 McCall
6,295,783 B1 10/2001 Davis
6,305,670 B1 10/2001 Ward et al.
6,308,937 B1 * 10/2001 Pettit ..... 256/65.05
6,332,657 B1 12/2001 Fischer
6,398,193 B1 * 6/2002 DeSouza ..... 256/65.06
6,412,250 B2 7/2002 Davis
6,413,004 B1 7/2002 Lin
6,467,756 B1 10/2002 Elsasser
6,471,192 B1 10/2002 Erwin
6,516,581 B2 2/2003 Paul et al.
6,543,751 B1 4/2003 Spruill
6,557,831 B2 5/2003 Erwin
6,565,069 B2 5/2003 Morris
6,643,982 B1 11/2003 Lapp et al.
6,805,335 B2 * 10/2004 Williams ..... 256/67
6,993,843 B2 * 2/2006 Quaintance et al. ..... 29/897.31
6,994,326 B1 * 2/2006 Tyson ..... 256/1
7,007,363 B2 3/2006 Forbis
7,048,259 B2 * 5/2006 Quaintance et al. ..... 256/65.06
7,129,412 B2 10/2006 Pierce
7,427,055 B2 * 9/2008 Platt ..... 256/65.06
7,503,550 B2 * 3/2009 Liefke ..... 256/24
2002/0106469 A1 8/2002 Fanucci
2004/0025460 A1 2/2004 Terrels
2004/0051092 A1 3/2004 Curatolo
2004/0206028 A1 10/2004 Terrels et al.
2005/0051761 A1 3/2005 Caissie et al.

FOREIGN PATENT DOCUMENTS

CA 2 468 481 11/2004
FR 2 529 925 1/1984

OTHER PUBLICATIONS

International Search Report for PCT/US2006/016735; Date Completed Sep. 28, 2006; date Mailed Apr. 10, 2007.

* cited by examiner

POST AND RAILING ASSEMBLY WITH SUPPORT BRACKET COVERS

RELATED APPLICATIONS

This application claims the benefit under 35 U.S.C. §119 of U.S. Provisional Application Ser. No. 60/995,911, filed Sep. 28, 2007, the contents of which are hereby incorporated by reference in their entirety for all purposes.

FIELD OF THE INVENTION

The present invention relates generally to post and railing systems, and more specifically to components and methods for mounting railings to support structures.

BACKGROUND

Post and railing systems, such as guard rail systems for decks and porches, have traditionally been constructed using a variety of timber, including pine and cedar. Although timber is a reasonably sturdy material, timber wears down over time, yielding to extreme weather conditions, prolonged rotting, termite infestation, and other factors. Even treated timber can experience rotting and warping. The development of polyvinylchloride (PVC) and other plastics has led to the use of plastics in post and railing assemblies. Although plastic railing materials are more durable than timber in many respects, known plastic railing systems have some drawbacks. For example, some plastic systems include a large number of fasteners and parts that make installation difficult and costly. In addition, many plastic railing systems have visible flaws that detract from the overall visual impression of the finished assembly and reflect a low standard of workmanship.

To address these drawbacks, some railing systems use a cover over the junction between the end of the railing and the support structure. A cover may be used to conceal unclean cuts at the end of the railing, abrupt transitions between the railing and post, and/or brackets and screws that are visible at the junction of the railing and post. A problem with conventional covers is that they too require visible fasteners to connect them to the assembly. Often times, these screws are left in plain view, detracting from the appearance of the cover. Covers that require fasteners increase the number of small parts to be handled in the field, which in turn, increases installation time and labor. Therefore, conventional attempts to improve the appearance of post and railing systems leave much to be desired.

SUMMARY OF THE INVENTION

In accordance with one embodiment of the invention, a method for installing a post and railing assembly includes the steps of providing a post structure with a mounting bracket extending from the post structure, the bracket having an underside with a receptacle, mounting the post structure to a support surface, providing an elongated railing member having an end, lowering the end of the railing member onto the mounting bracket, providing a trim cover, the trim cover comprising a ring-shaped body forming a central opening, the ring-shaped body having a slit opening and a locking member projecting inwardly relative to the ring-shaped body into the central opening, flexing the trim cover to expand the slit opening until the slit opening is wide enough to permit passage of the railing and bracket into the central opening, wrapping the trim cover around the bracket and railing end so that the bracket and railing end pass through the slit opening into the central opening, with the locking member aligned with the receptacle on the underside of the bracket, and locking the trim cover around the railing and bracket by pressing the locking member into the receptacle.

In another exemplary embodiment of the invention, a method for installing a post and railing assembly includes the steps of providing a post structure with a railing mounting bracket extending from the post structure, the bracket having an underside with a channel, mounting the post structure to a support surface, providing an elongated railing member having an end, anchoring the end of the railing member to the mounting bracket, providing a trim cover, the trim cover comprising a ring-shaped body forming a central opening, the ring-shaped body having a slit opening and a locking member projecting inwardly relative to the ring-shaped body into the central opening, flexing the trim cover to expand the slit opening until the slit opening is wide enough to permit passage of the railing and bracket into the central opening, wrapping the trim cover around the bracket and railing end so that the bracket and railing end pass through the slit opening into the central opening, with the locking member aligned with the receptacle on the underside of the bracket, and locking the trim cover around the railing and bracket by pressing the locking member into the receptacle.

In another exemplary embodiment of the invention, a railing mounting assembly for mounting the end of a railing to a post structure includes a U-shaped bracket having a pair of sidewalls and a bottom wall, the bottom wall comprising a pair of platform portions for supporting a railing, and a pair of recessed portions that are offset from the platform portions so as to form a cavity in the bracket, the recessed portions being separated from one another by a channel, and a trim cover attached around the bracket, the trim cover having a ring-shaped wall surrounding a central opening, the wall comprising a slit and at least one locking member projecting through the channel of the U-shaped bracket into the cavity.

BRIEF DESCRIPTION OF THE DRAWING FIGURES

The foregoing summary and the following description of exemplary embodiments of the invention will be better understood in conjunction with the drawing figures of which:

DETAILED DESCRIPTION OF PREFERRED EMBODIMENTS OF THE INVENTION

Figure 1:
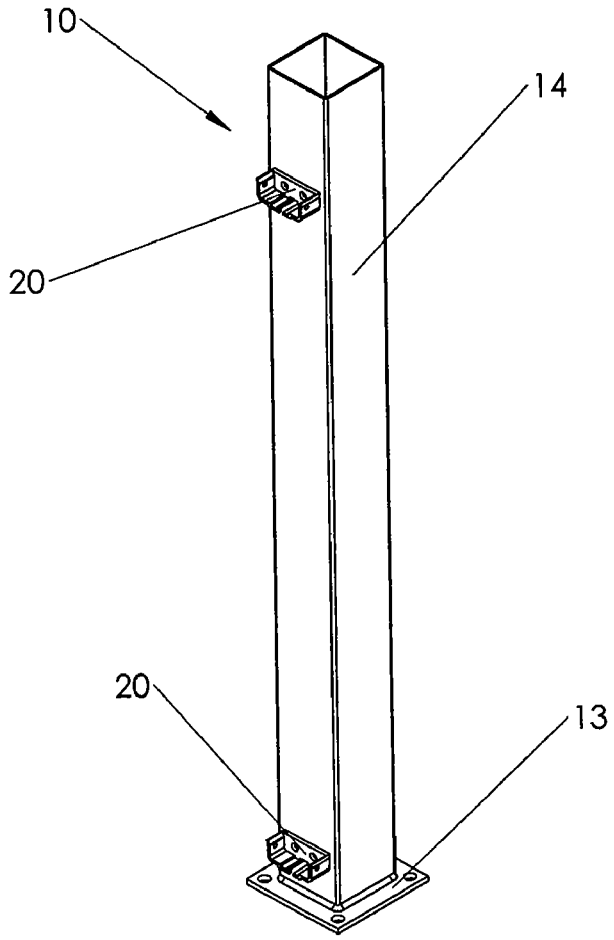
FIG. 1 is a perspective view of pre-assembled components of a first post assembly in accordance with an exemplary embodiment of the invention.
Figure 2:
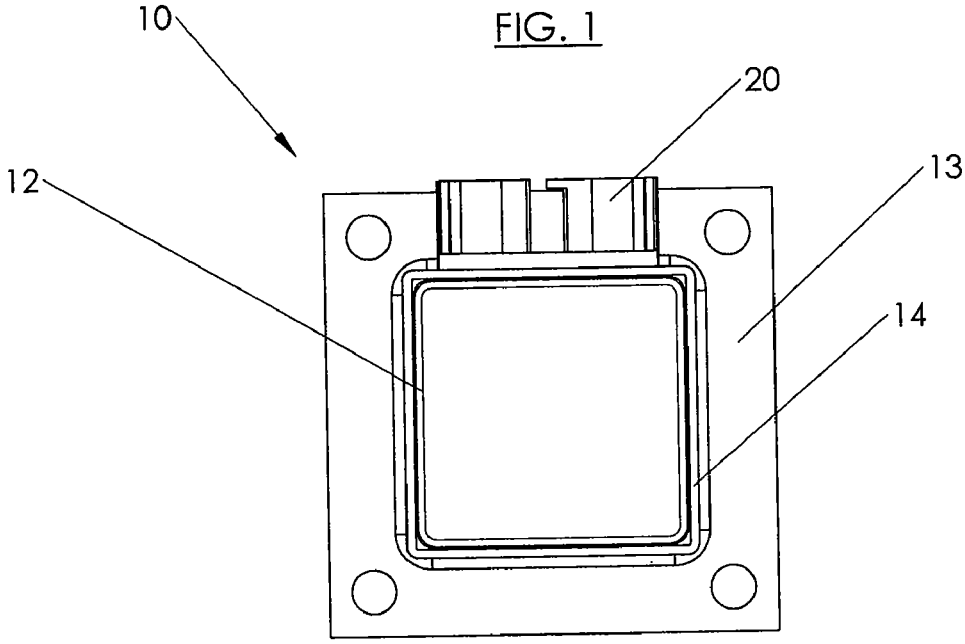
FIG. 2 is a top view of the components of FIG. 1.
Figure 3:
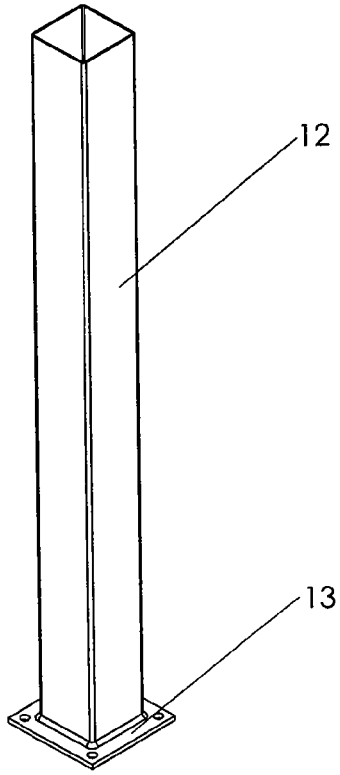
FIG. 3 is a perspective view of a post core component in accordance with an exemplary embodiment of the invention.
Figure 4:
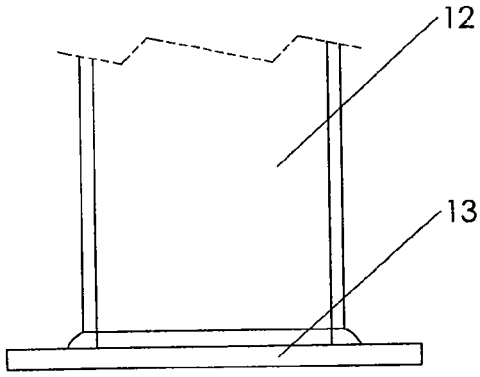
FIG. 4 is a truncated side view the post core component of FIG. 3.
Figure 5:
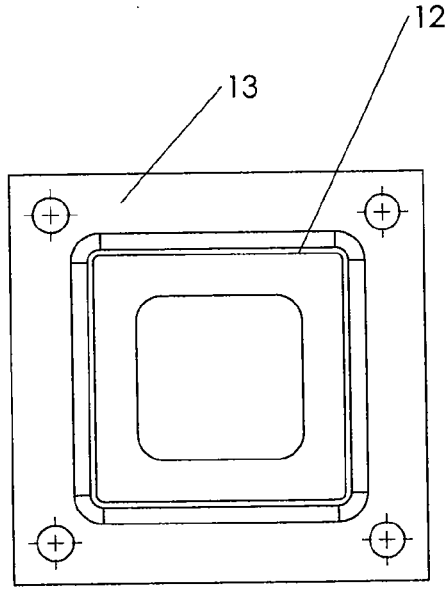
FIG. 5 is a top view of the post core component of FIG. 3.
Figure 6:
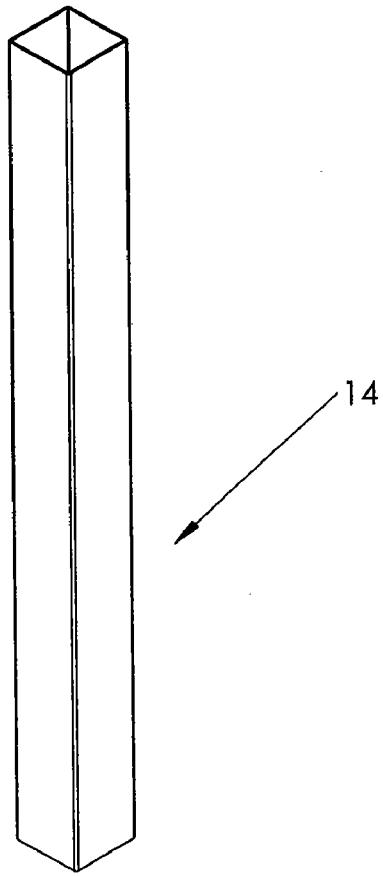
FIG. 6 is a perspective view of a sleeve component in accordance with an exemplary embodiment of the invention.
Figure 7:
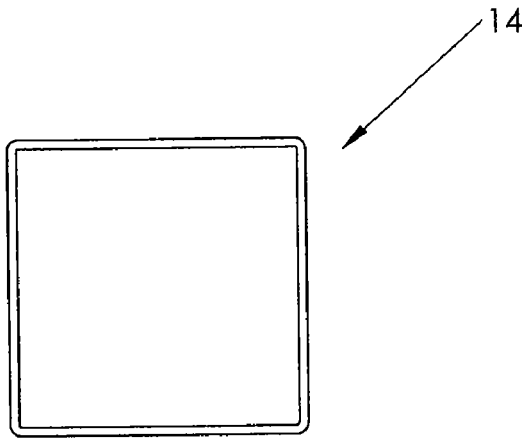
FIG. 7 is a top view of the sleeve component of FIG. 6.

Although the invention is illustrated and described herein with reference to specific embodiments, the invention is not intended to be limited to the details shown. Rather, various modifications may be made in the details within the scope and range of equivalents of the claims and without departing from the invention.

A post and railing assembly in accordance with the invention is manufactured and sold in pre-assembled units, allowing manual assembly in the field with the use of a minimal number of fasteners and tools. The assembly includes a pre-assembled post with pre-mounted support brackets. During installation, a pair of the pre-assembled posts are mounted in place, and a pre-assembled railing span is connected between the posts using the pre-mounted brackets. Rails on the railing span are secured in the brackets by fasteners. The brackets are then concealed by applying a cover trim around the mounted railing. The cover trims are secured to the underside of the mounting bracket manually by a "snap-on" type connection, which may be a compression fit, a ratchet connection, or other type of connection. The combination of pre-assembled, pre-fabricated assembles with snap-on components results in an unexpectedly sturdy post and railing assembly that is inexpensive and easy to install.

FIGS.

Referring now to FIGS. 1-7, a pre-assembled post assembly 10 is shown in accordance with the invention. Assembly 10 includes a post core 12 and a cover sleeve 14 coaxially mounted over the post core. Post core 12 has a bottom flange 13 for mounting to a porch floor, deck, or other mounting surface. A pair of U-shaped brackets 20 are mounted on the exterior of sleeve 14 at a spacing that corresponds to the spacing between upper and lower rails on a railing span. Brackets 20 are configured for mounting a railing in a horizontal or level railing installation. As will be discussed below, different bracket configurations are provided for inclined installations, such as railings along ramps or staircases.

FIG. 1 illustrates an exemplary embodiment of a pre-assembled post for the end of a railing. The post is configured to support a railing span on one side only. The brackets are arranged so as to support a pre-assembled railing span, the latter also being a pre-assembled unit in accordance with the invention.

Figure 8:
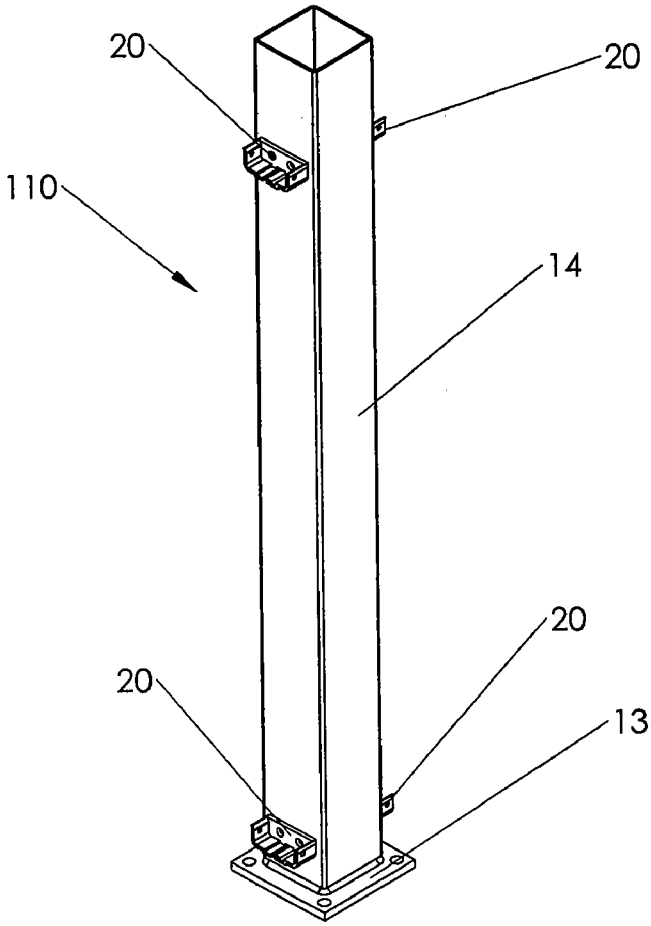
FIG. 8 is a perspective view of pre-assembled components of a second post assembly in accordance with an exemplary embodiment of the invention.
Figure 9:
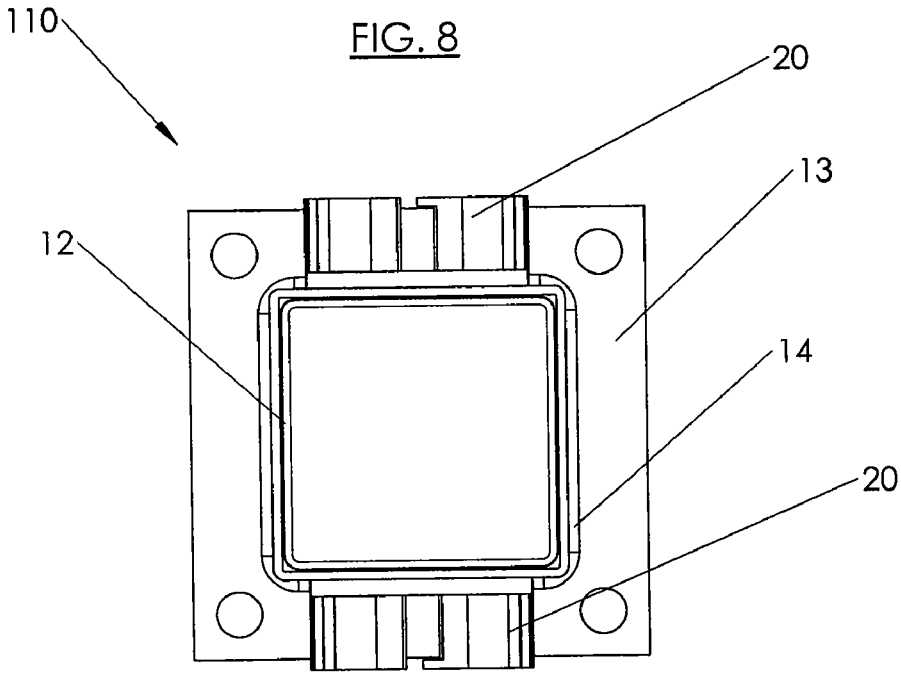
FIG. 9 is a top view of the components of FIG. 8.
Figure 10:
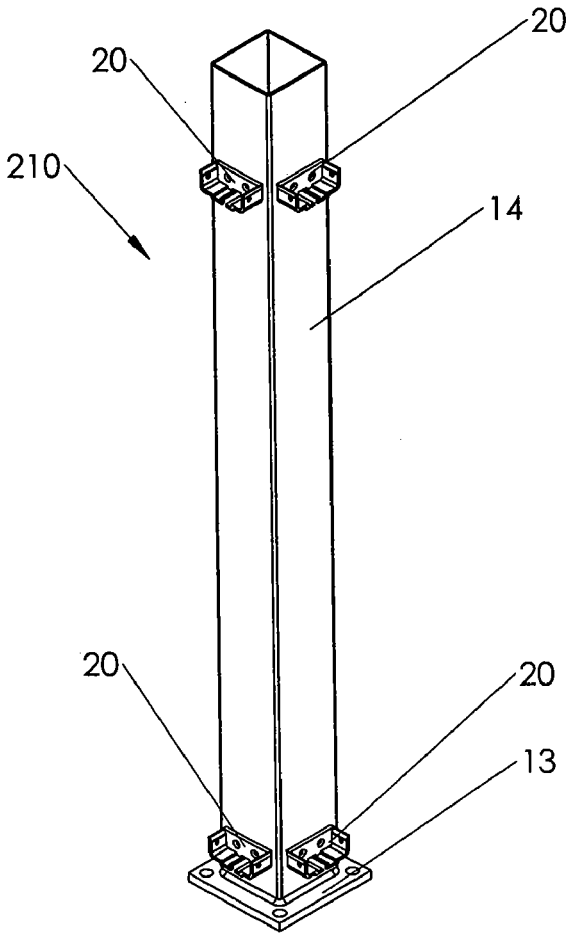
FIG. 10 is a perspective view of pre-assembled components of a third post assembly in accordance with an exemplary embodiment of the invention.
Figure 11:
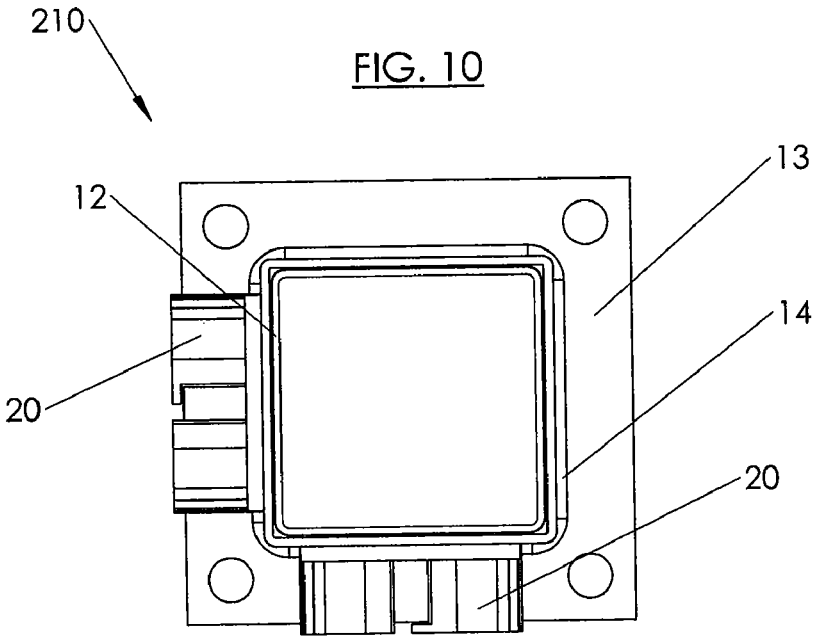
FIG. 11 is a top view of the components of FIG. 10.

Referring now to FIGS. 8 and 9, an alternative exemplary embodiment of a pre-assembled post assembly 110 is shown for use as a junction for a straight railing. Post assembly 110, which may utilize the same components described in connection with FIGS. 1-7, is configured to support two railing spans on opposite sides of the post assembly. FIGS. 10 and 11 further illustrate an exemplary embodiment of a pre-assembled post assembly 210 for use as corner post. Post assembly 210, which may also utilize the same components described in connection with FIGS. 1-7, is configured to support two railing spans on adjacent sides of the post assembly, forming a right angle.

Figure 12:
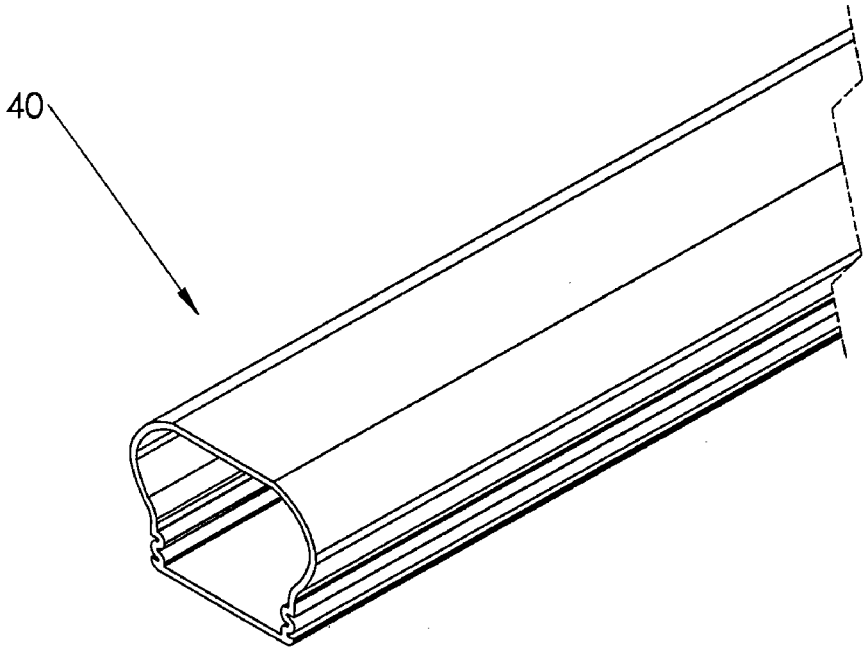
FIG. 12 is a truncated perspective view of a first railing component in accordance with an exemplary embodiment of the invention.
Figure 13:
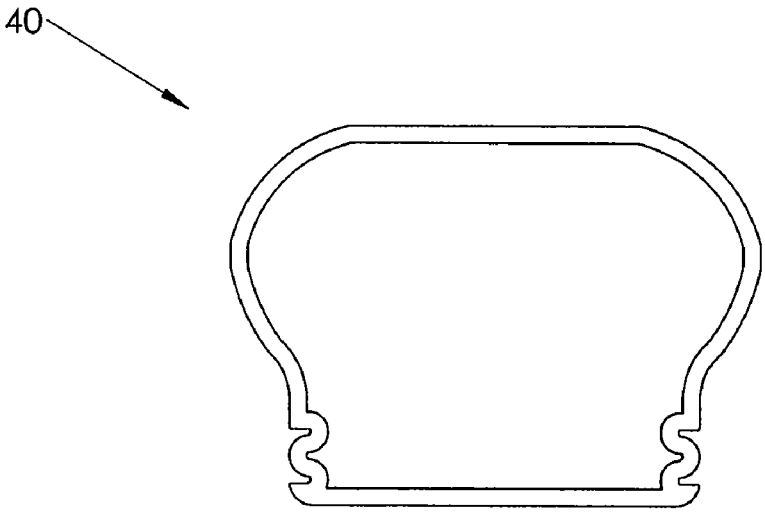
FIG. 13 is an end view of the railing component of FIG. 12.
Figure 14:
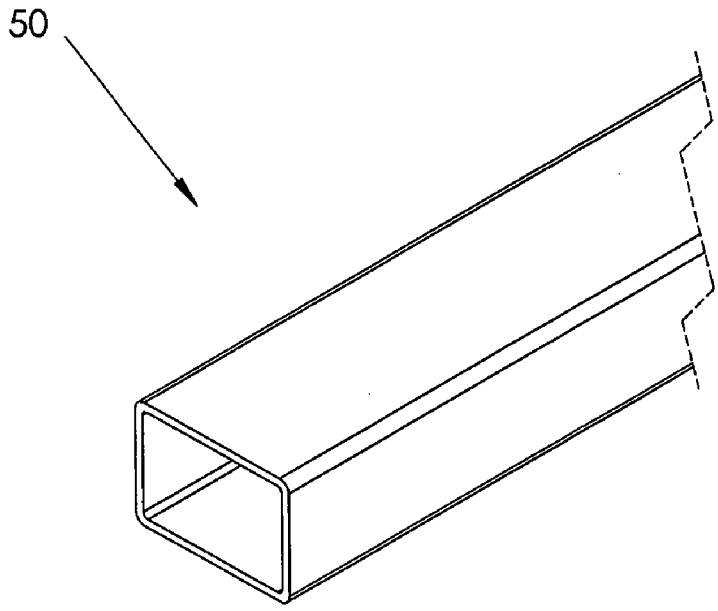
FIG. 14 is a truncated perspective view of a second railing component in accordance with an exemplary embodiment of the invention.
Figure 15:
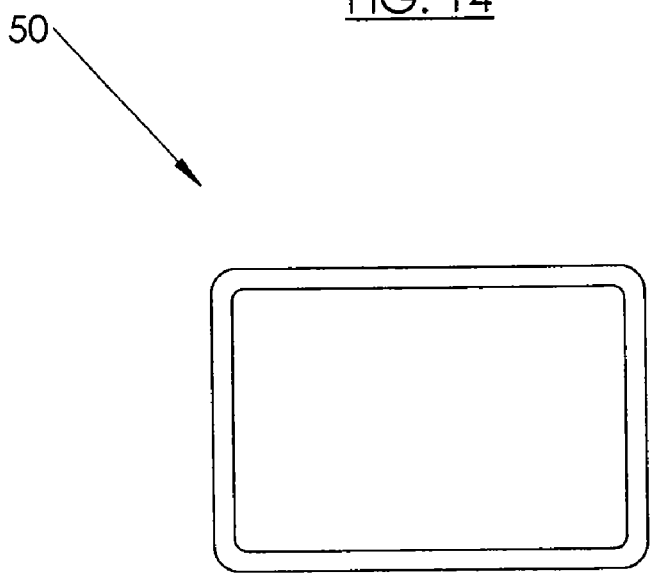
FIG. 15 is an end view of the second railing component of FIG. 14.

FIGS. 12 and 13 illustrate an exemplary embodiment of a top railing 40 used in a pre-assembled railing span in accordance with the invention. FIGS. 14 and 15 illustrate an exemplary embodiment of a bottom railing 50 used in a pre-assembled railing span in accordance with the invention. Top and bottom railings 40 and 50 are preferably formed of an extruded plastic, such as polyvinylchloride (PVC), or a synthetic composite material. In preferred embodiments of the system, railings 40 and 50 are made in standard lengths that correspond to preferred railing panel widths. This allows fabricators to construct pre-fabricated railing panels without cutting the railings down to a required size. Alternatively, the railings may be manufactured and delivered to the installation site in longer lengths that can be cut down to desired lengths. As discussed below, the railing system of the present invention has components to conceal the cut ends of railings, so that clean cuts need not be made in the field. This simplifies installation in cases where the installation requires a customized width for the railing panel that is shorter than the standard width.

Figure 16:
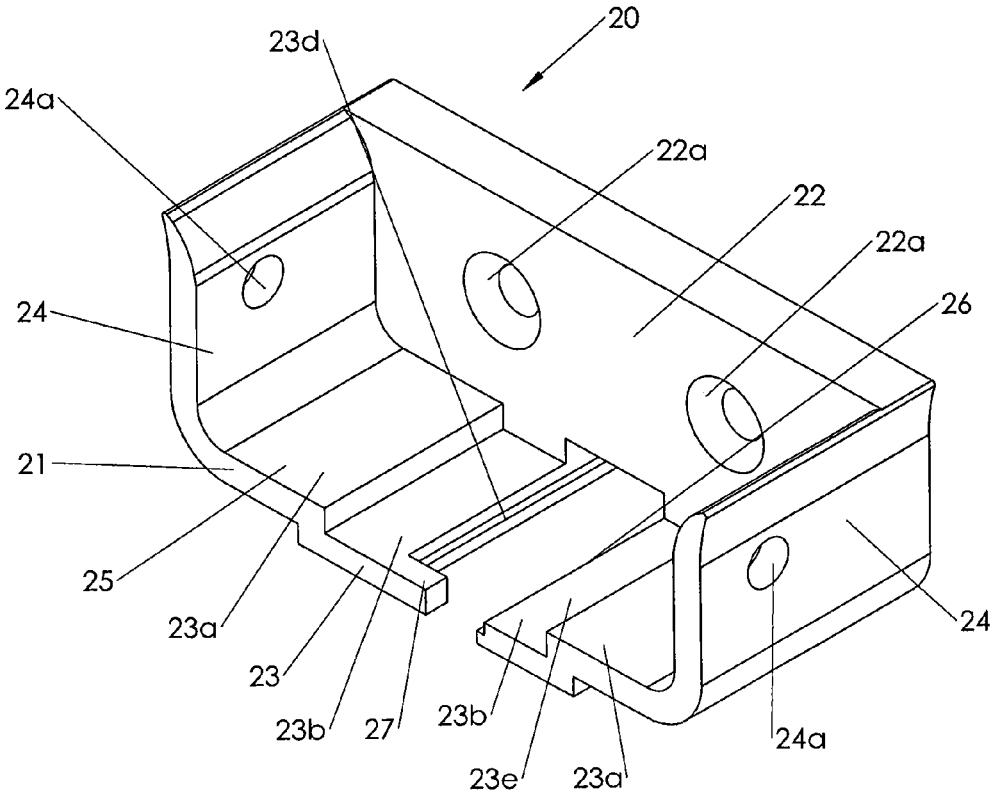
FIG. 16 is a perspective view of a first bracket component in accordance with an exemplary embodiment of the invention.
Figure 17:
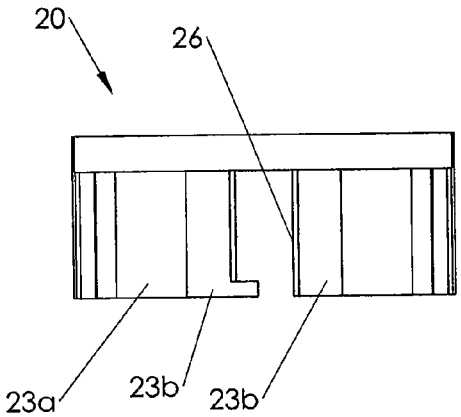
FIG. 17 is a top view of the bracket of FIG. 16.
Figure 18:
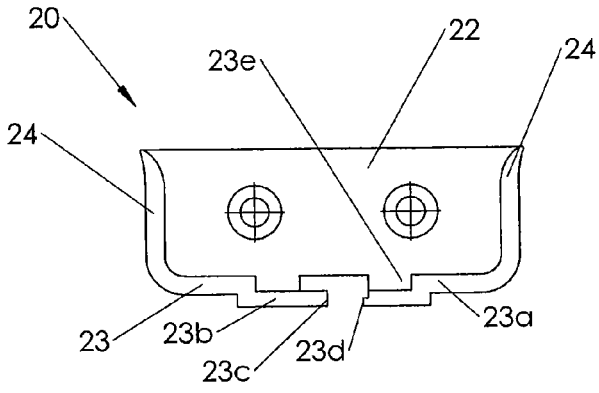
FIG. 18 is a front view of the bracket of FIG. 16.

Referring now to FIGS. 16-18, the mounting bracket 20 is shown in more detail. Bracket 20 has a generally U-shaped body 21 comprising a rear mounting wall 22, a bottom wall 23, and a pair of side walls 24 having a curved section that merges with the bottom wall. Bottom wall 23 and curved side walls 24 form a cradle 25 having a having a width that corresponds with the lateral width of the bottom portions of the top and bottom railings 40 and 50. The curved side walls 24 have an inner curvature that corresponds with the curvature of the rounded bottom corners of top and bottom railings 40 and 50. In this configuration, the cradle 25 receives the end of a top or bottom railing in a smooth sliding fit.

Bottom wall 23 has a stepped contour that includes a pair of platform portions 23*a* that are contiguous with sidewalls 24, and a pair of offset or recessed portions 23*b*. The offset portions 23*b* are separated from each other by a channel 26 that extends axially through the bottom wall 23. A stop 27 projects inwardly into channel 26 from one of the offset portions 23*b*. As will be explained in more detail, stop 27 prevents axial movement of a trim cover that is snapped over the bracket in the finished assembly, thereby holding the trim cover firmly against the post, and maintaining a secure compression fit between engagement surfaces on the bracket and the trim cover that mate with one another.

The rear wall 22 and side walls 24 are formed with apertures for receiving fasteners. The shape, size and arrangement of apertures may vary, depending on factors including but not limited to the type of fasteners used, the weight of the railing span being supported, and other considerations. In FIG. 16, rear wall 22 includes a pair of fastener holes 22*a* to mount the bracket 20 on the post sleeve 14. Sidewalls 24 each include a single fastener hole 24*a* for receiving a fastener to anchor a railing end in the bracket. Fastener holes 24*a* allow a fastener, such as a screw, to be driven through the sidewalls 24 of bracket 20 and into the side of railing seated in the bracket.

Figure 25:
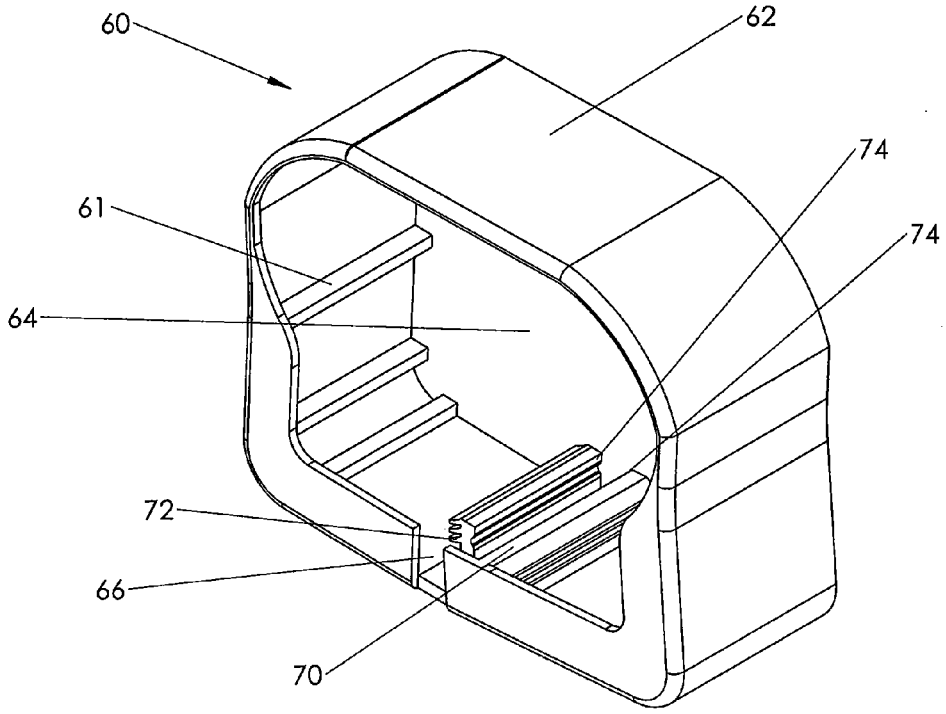
FIG. 25 is a perspective view of a first trim cover in accordance with an exemplary embodiment of the present invention.
Figure 26:
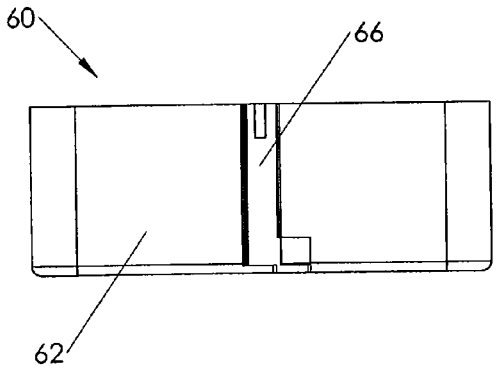
FIG. 26 is a bottom view of the first trim cover of FIG. 25.
Figure 27:
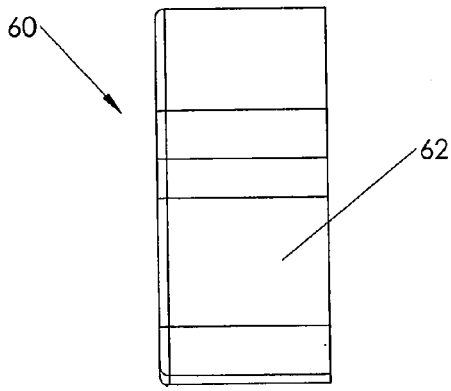
FIG. 27 is a side view of the first trim cover of FIG. 25.

Referring now to FIGS. 25-27, a top rail bracket trim cover 60 is shown in accordance with the present invention. Trim cover 60 has a ring-like body 62 that is configured to wrap over the top of a railing that rests in the support bracket 20, and connect to the underside of the bracket. In the preferred embodiment, trim cover 60 connects to the underside of the bracket using a snap-connection. The phrase "snap-connect", "snap-connector" or "snap-connection" as used herein is intended to refer to physical couplings between components that rely solely on the direct engagement of adjoining surfaces, and that do not utilize separate screws, nails, glues, welds, adhesives or other fasteners that must be applied to the components. Snap-connections include but are not limited to ratchet connections, compression fits, and flexible tabs and slots. The trim cover 60 snap-connects around the railing and bracket at the junction of the railing and post to conceal the cut end of the railing and the bracket, thereby providing an aesthetically pleasing transition at the post. Because the trim cover 60 conceals cut ends of railings, the railings can be quickly cut to a length that is close to the desired span length, but need not be precise or clean cuts. Cuts that are imprecise or jagged will be concealed inside trim cover 60.

Ring-like body 62 forms an opening 64 for receiving a rail. Opening 64 may be designed with a hole perimeter that exactly matches the size and shape of the railing to be installed, or provide a small amount of clearance on all sides of the railing. In FIG. 25, opening 64 has a hole perimeter that exactly matches the cross-sectional geometry of top railing 40 shown in FIG. 12. Ring-like body also includes a bottom slit 66, and is preferably formed of an elastic material, such as a resilient flexible plastic or other shape memory material. Trim cover 60 is flexibly expandable by virtue of bottom slit 66 to allow the body 62 to open at the bottom and receive a railing into the opening. The elasticity of trim cover 60 allows the trim cover to be flexed around the railing and support bracket 20 after the railing is mounted on the bracket, and subsequently returned to its original shape, which will surround the ends of both the railing and bracket adjacent a support post.

A plurality of spacer bars 61 extend around the ring-shaped body 62. Spacer bars 61 have widths designed to engage the perimeter sidewalls of a railing around which the trim cover is placed. The space between the spacer bars 61 corresponds to the outer perimeter of the railing so as to snugly engage the railing. Preferably, one or more of the spacer bars 61 frictionally engage the exterior of the railing to better stabilize the assembly and its components. The spacer bars are optional, however, because the engagement of the trim cover 60 and bracket 20 can provide a substantial amount of stability by itself.

Trim cover 60 further includes a connector for engaging the underside of bracket 20 at a visibly obstructed location. Preferably, trim cover 60 includes a snap-connector. In FIGS. 25-28, body 62 includes a snap-connector in the form of a pair of parallel bars 70, one on each side of slit 66. Bars 70 each include a series of parallel flanges or ribs 72. Each bar 70 has an inward face 74 adjacent the slit. In this arrangement, the bars 70 can be converged together with the inward faces abutting one another when body 62 is flexed to a closed position. In the closed position, the combined maximum width of the bars 70 is equal to or slightly greater than the width of channel 26 on the underside of bracket 20.

Channel 26 of bracket 20 is adapted to receive bars 70 on cover trim 60 in a snap-connection. More specifically, channel 26 has dimensions that are adapted to receive bars 70 by insertion and physical engagement of the bars. Offset portions 23*b* of bottom wall 23 each have an inwardly facing engagement surface 23*d* adapted to engage one of the bars 70 on trim cover 60. Preferably, engagement surfaces 23*d* include one or more surface discontinuities that engage the ribs 72 on bars 70 so as to provide a secure compression fit. In FIGS. 16 and 18, engagement surfaces 23*c* each include a longitudinal flange projection 23*d* that engages the ribs 72 on bars 70, providing a compression fit. It will be understood that the ribs 72 and flanges 23*d* are exemplary embodiments only, and other surface configurations may be used to connect the bracket 20 and trim cover 60.

Unlike conventional railing and bracket systems, the engagement surfaces between bracket 20 and trim cover 60 permit a strong compression fit that can be readily assembled by hand, and if desired, readily disassembled by hand. The amount of compression fit may be controlled by adjusting the relative dimensions of ribs 72, flanges 23*d*, and/or the channel 26, to allow bars 70 to be reversed out of the channel. Reversal of the bars 70 out of the channel allows trim cover 60 to be separated from bracket 20 in the event that the railing section needs to be disassembled from the post. The railing systems of the invention are designed to be permanent installations, but with a flexibility of design that allows easy disassembly. This is very advantageous in cases where the railing system needs to be moved or expanded.

The offset wall portions 23*b* of bottom wall 23 are positioned so as to be spaced apart from the bottom of a railing that rests in bracket 20. The vertical offset of offset wall portions 23*b* thereby creates a hollow cavity 23*e* between the bottom of the railing and the bottom wall 23 of bracket 20. Cavity 23*e* is sized so as to receive the full height of bars 70 when trim cover 60 is secured around bracket 20.

In the preferred embodiment, trim cover 60 holds the railing under a compression force that creates a rigid hold around the bracket and railing. In this way, trim cover 60 is more than a decorative accessory, but functions like a clamp to help hold the assembly together. Each of bars 70 has a flat elongated top surface 71. Top surfaces 71 bear against the bottom of the railing and force the railing upwardly against spacer members 61 at the top of trim cover 60. The spacer members 61 bear against the top of the railing in response to this, so that the railing is caught in a compressive hold between the bracket and trim cover.

During assembly, the railing end is placed into the bracket 20 by dropping the railing end through the top opening of the U-shaped bracket and resting the railing end in the cradle 25. The railing is then anchored to the sidewalls 24 of bracket 20 with fasteners, such as screws. Once the end of the railing is placed in the bracket, the trim cover 60 is flexed open and wrapped around the railing and bracket. This is done by pulling apart the bottom portion of trim cover 60 at slit 66 and stretching the trim cover over the railing and bracket. Once the split bottom portion of trim cover 60 is pulled down underneath the railing and bracket, the split portions are released from the flexed or stretched condition. The bottom of trim cover 60, which is flexed apart at slit 66, is closed so as to bring the bars 70 into abutment, or at least into proximity to one another. Once the bars 70 are brought together, the bottom of trim cover 60 is pressed upwardly until the bars pass into channel 26 of the bracket. This is easily done by applying finger pressure to the underside of trim cover 60 and squeezing the bottom of the trim cover upwardly to advance the bars up into the channel 26. Upon entering channel 26, ribs 72 on the bars 70 contact the engagement surfaces 23*d* on offset wall portions 23*b*. Ribs 72 may deflect in response to contact with the engagement surfaces 23*d*. The flange 23*d* and ribs 72 form a friction or compression fit that resists reverse sliding, firmly securing the trim cover 60 to the bottom of the bracket 20 and around the railing, at the post.

Bars 70 and channel 26 provide a totally concealed locking mechanism on the underside of the installed railing. That is, bars 70 and channel 26 are positioned on the bottom of the rail, adjacent the support post. At this location, there are no visible fasteners, joints, couplings or other visible connections on the trim cover above the railing, making the transition between the railing and post more visually appealing. The only visible feature attributable to the locking mechanism is a small seam formed by channel 26 at the base of the trim cover 60. The seam is visually obstructed from all points of view above the finished railing installation. From points of view beneath the railing installation, as for example, at ground level looking up at a second story deck railing, the seam is virtually undetectable.

Figure 28:
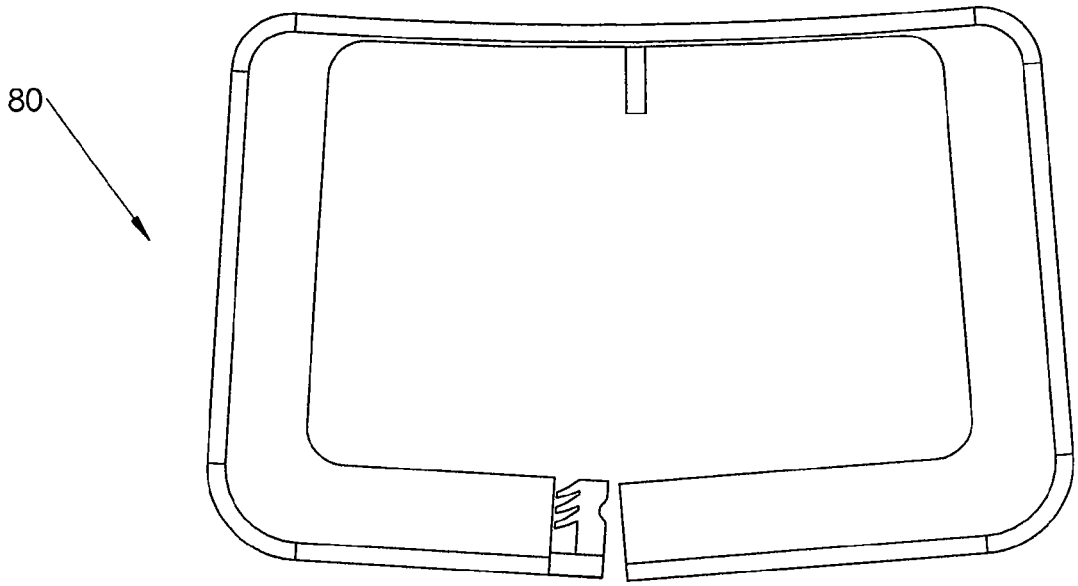
FIG. 28 is a front view of a second trim cover in accordance with an exemplary embodiment of the present invention.
Figure 29:
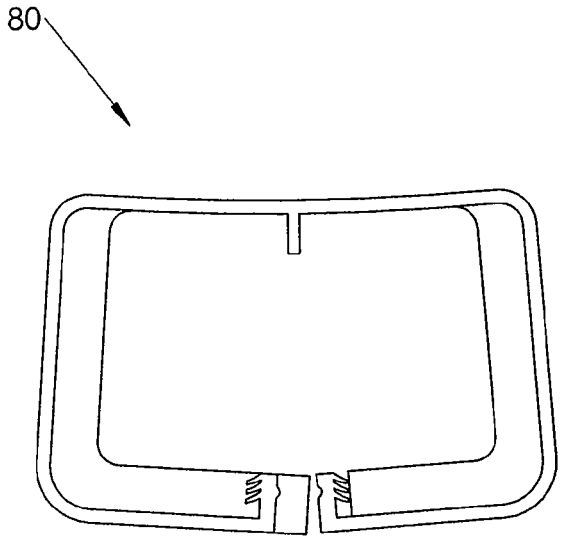
FIG. 29 is a rear view of the second trim cover of FIG. 28.
Figure 30:
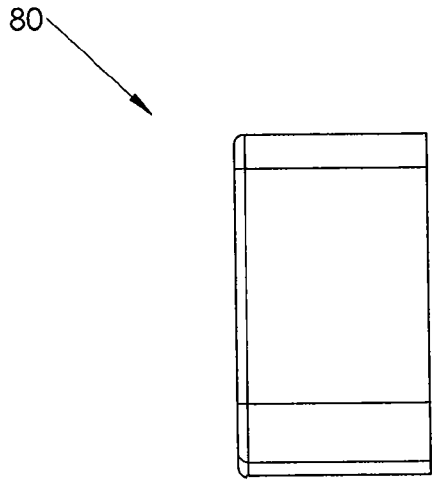
FIG. 30 is a side view of the second trim cover of FIG. 28.

FIGS. 28-30 illustrate a bottom rail bracket trim cover 80 in accordance with the present invention. Bottom rail trim cover 80 is similar in many respects to top rail bracket trim cover 60, but includes a generally rectangular shape to conform to a rectangular bottom rail.

A number of alternative components will be described in the following paragraphs, including alternative brackets and trim covers. Many of the alternative components have identical or analogous parts that will be apparent from the description or drawing figures. These parts function identically or analogously to the corresponding parts described in the previous paragraphs, and will not be described except where additional description is required.

Figure 19:
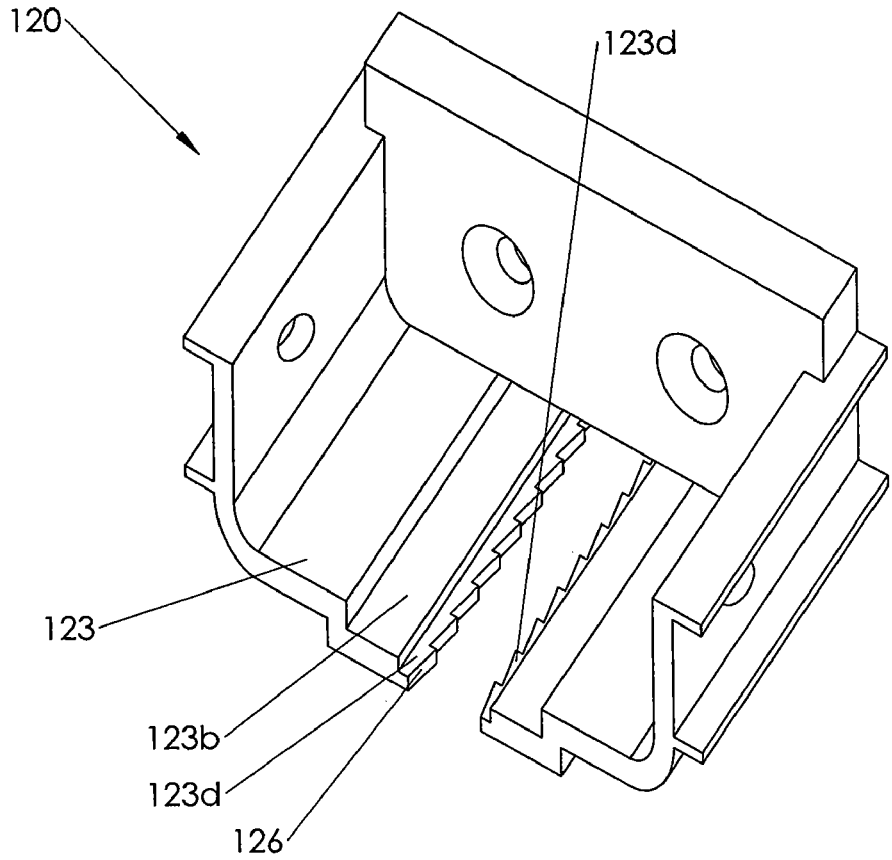
FIG. 19 is a first perspective view of a second bracket component in accordance with an exemplary embodiment of the invention.
Figure 20:
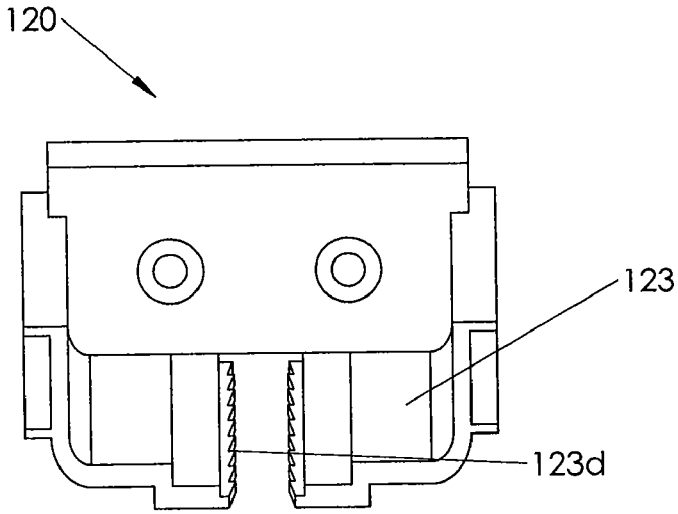
FIG. 20 is a second perspective view of the second bracket component of FIG. 19.
Figure 21:
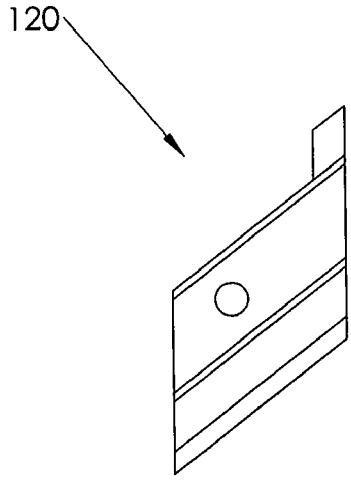
FIG. 21 is a side view of the second bracket component of FIG. 20.
Figure 22:
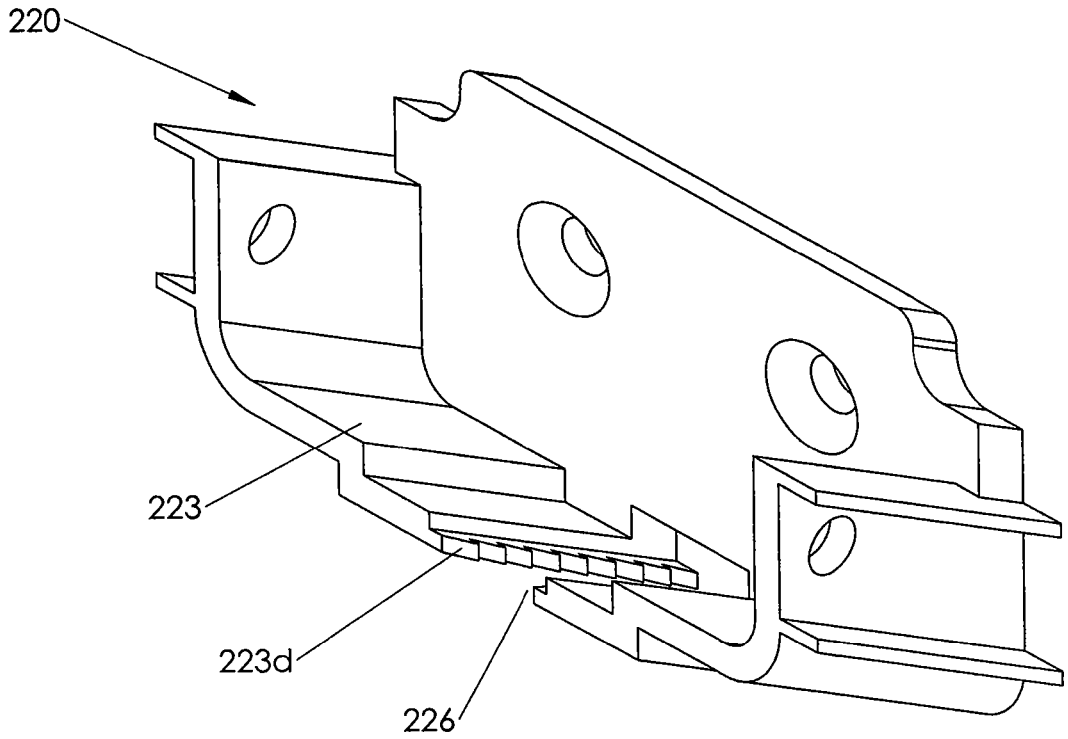
FIG. 22 is a first perspective view of a third bracket component in accordance with an exemplary embodiment of the invention.
Figure 23:
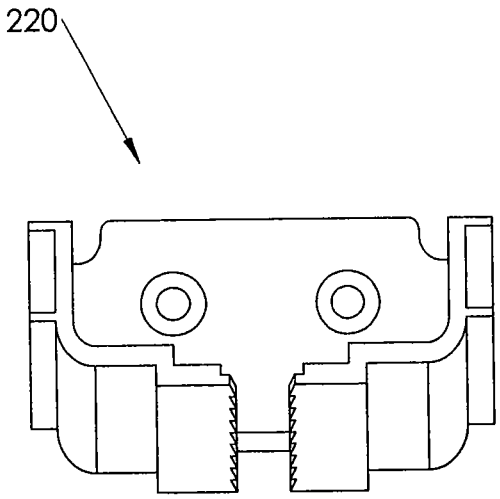
FIG. 23 is a second perspective view of the third bracket component of FIG. 22.
Figure 24:
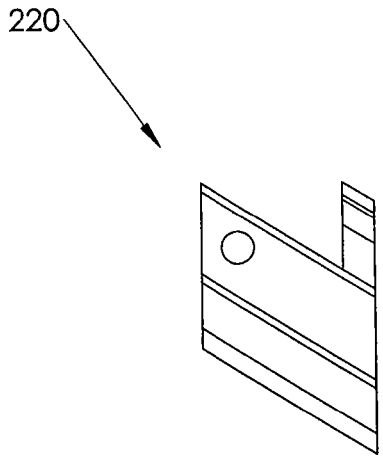
FIG. 24 is a side view of the third bracket of FIG. 22.

Referring now to FIGS. 19-24, alternative embodiments of brackets in accordance with the invention are shown. FIGS. 19-21 show a top inclined bracket 120 configured for supporting the upper or raised end of an inclined railing. FIGS. 22-24 show a bottom inclined bracket 220 configured for supporting the lower end of an inclined railing. Brackets 120, 220 are configured for mounting railings along staircases, ramps or other installations on which railings are mounted at angles other than approximately ninety degrees from posts or other support surfaces. Unlike level or horizontal railing installations, the brackets 120, 220 preferably provide both vertical and horizontal support of the railing. A number of configurations can be used to provide both vertical and horizontal support. Top inclined bracket 120 has a bottom wall 123 with opposing rows of ratchet teeth 123*d*, and bottom inclined bracket 220 similarly features a bottom wall 223 with opposing rows of ratchet teeth 223*d*.

Figure 31:
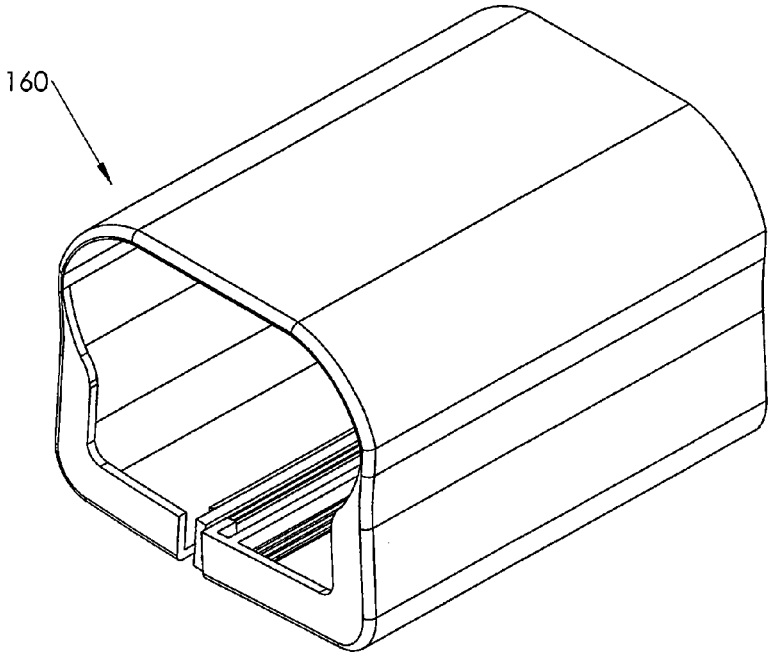
FIG. 31 is a first perspective view of a third trim cover in accordance with an exemplary embodiment of the invention.
Figure 32:
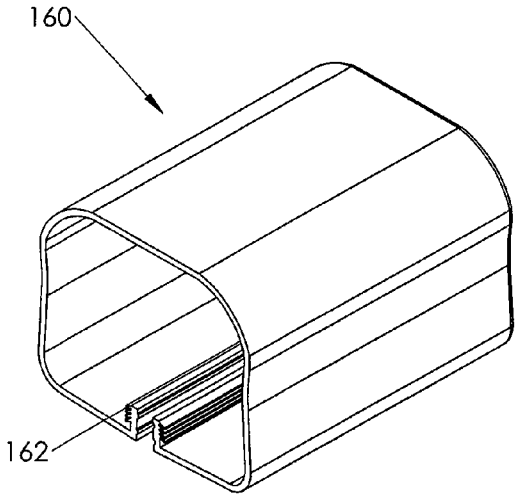
FIG. 32 is a second perspective view of the third trim cover of FIG. 31.
Figure 33:
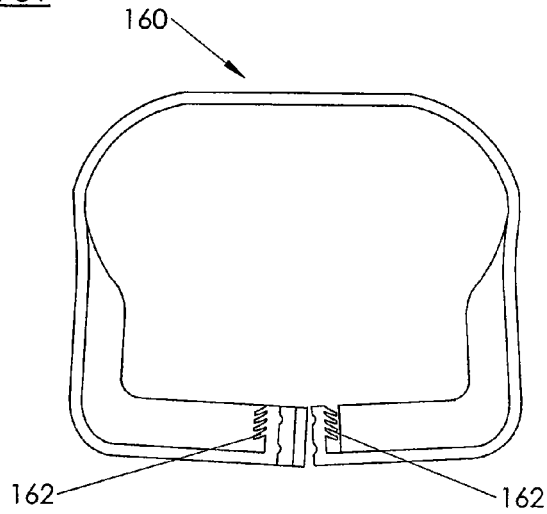
FIG. 33 is a rear view of the third trim cover of FIG. 31.
Figure 34:
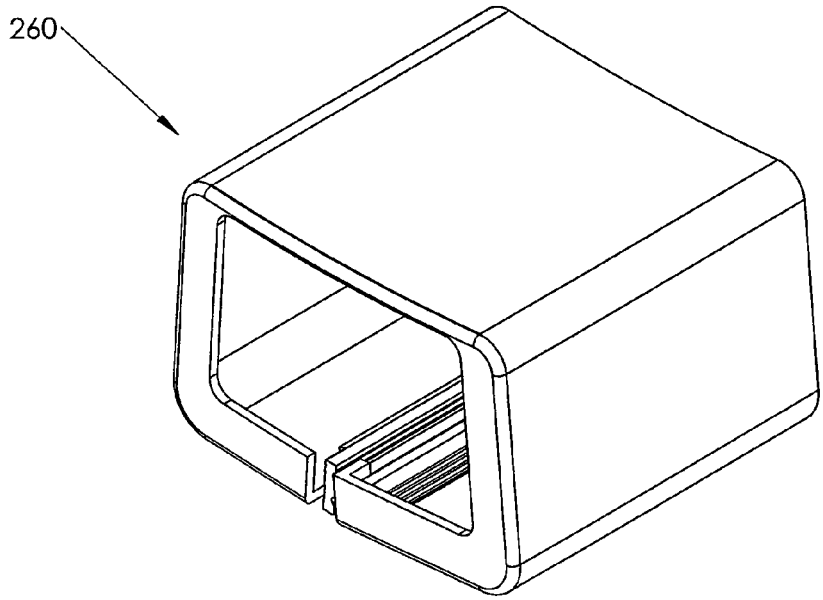
FIG. 34 is a first perspective view of a fourth trim cover in accordance with an exemplary embodiment of the invention.
Figure 35:
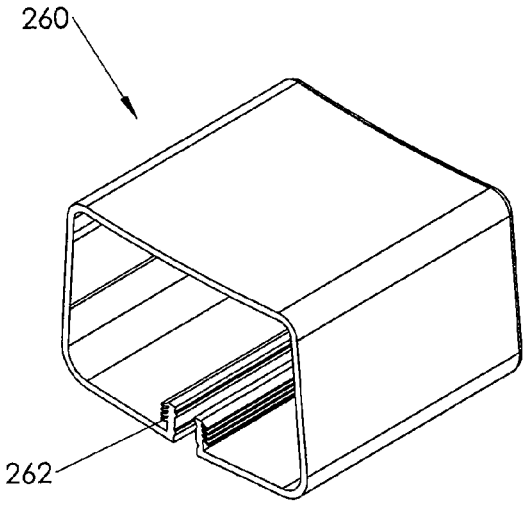
FIG. 35 is a second perspective view of the fourth trim cover of FIG. 34.
Figure 36:
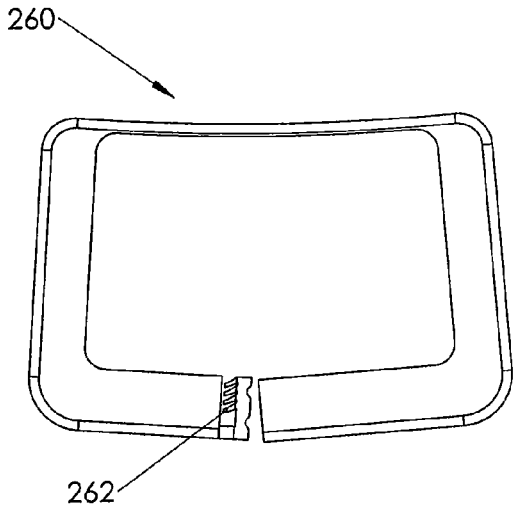
FIG. 36 is a front view of the fourth trim cover of FIG. 34.

Referring now to FIGS. 31-36, alternative embodiments of bracket trim covers in accordance with the invention are shown. The bracket trim covers in FIGS. 31-36 have many of the same features as trim covers described previously. FIGS. 31-33 illustrate a top inclined bracket cover 160 having a similar bar and ribs 162 as does bracket cover 60. The ribs 162 engage the ratchet teeth 123*d* of top inclined bracket 120, which are shown by example in FIG. 20, to lock the trim cover onto the bracket. Upon engagement of ribs 162 and ratchet teeth 123*d*, an interference will create a tight compression fit between the trim cover and bracket. In a preferred embodiment, the bracket is formed of aluminum or other metal, while the trim cover is formed of PVC. The much harder aluminum material will compress or even carve into the softer material of the trim cover, forming a tight fit. FIGS. 34-36 illustrate a bottom inclined bracket cover 260, which is similar in many respects to top inclined bracket cover 160, but includes a generally rectangular shape to conform to a rectangular bottom rail.

Figure 37:
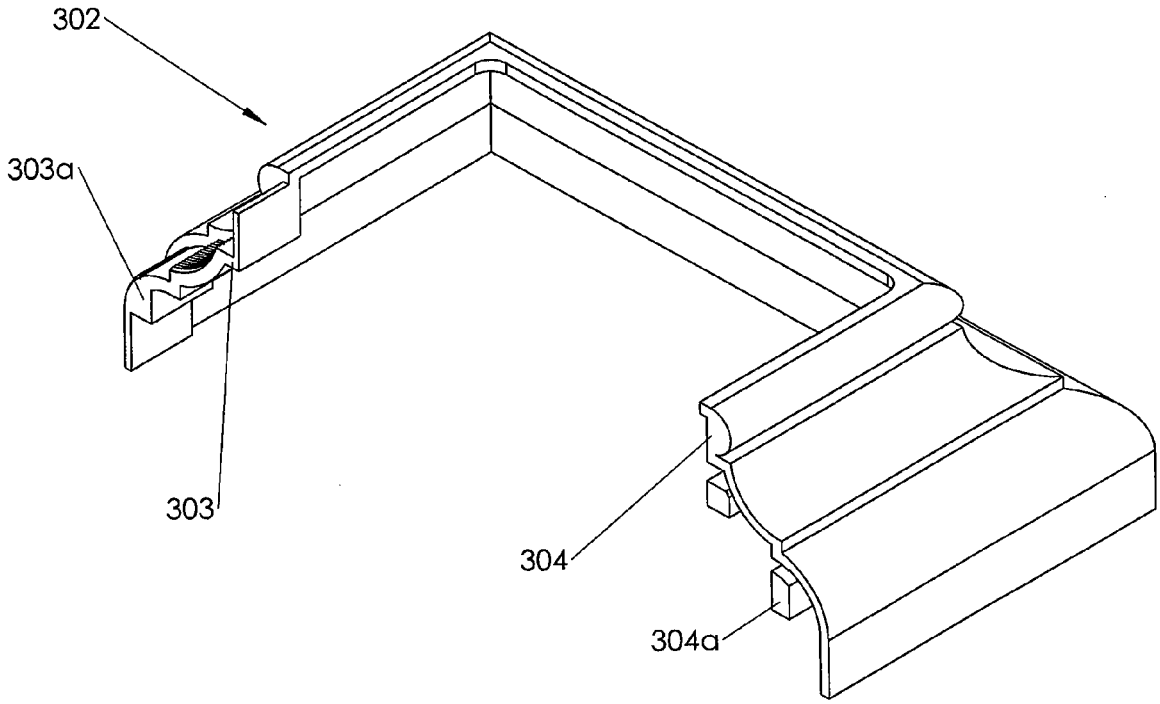
FIG. 37 is a perspective view of a first trim ring component in accordance with an exemplary embodiment of the invention.
Figure 38:
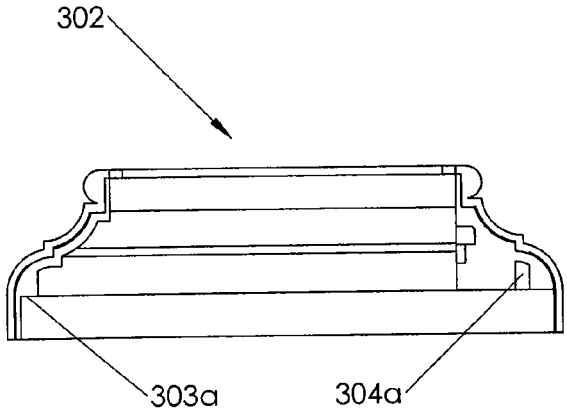
FIG. 38 is a front view of the trim ring component of FIG. 37.
Figure 39:
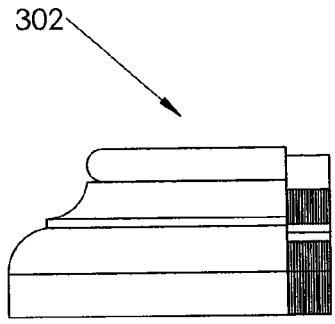
FIG. 39 is a side view of the trim ring component of FIG. 37.

FIGS. 37-39 illustrate an exemplary trim ring component 302 in accordance with the invention. Trim ring 302 is configured for placement around the post in a finished post assembly. More specifically, trim ring 302 is configured to lock to itself over the flange of a post, such as the flange 13 shown in FIG. 1, to conceal the flange and form a visually appealing transition at the base of the post. Trim component 302 has two different ratchet teeth designs on either side, which permits two identical components to be interlocked to one another. Side 303 of one component 302 is designed to fit into side 304 of an opposing component 302. Thus, when two trim components 302 are supplied, a ratcheted connection can be made with ratchet teeth 303*a* and 304*a*. The profiles are inserted into each other to connect the components in an arrangement that allows adjustment of the components so as to tightly conform to the perimeter of a post sleeve. The ratcheted surfaces 303*a* and 304*a* substantially prevent reverse sliding, or separation of trim ring component 302, once they are interconnected.

A variety of fixed or adjustable trim ring assemblies may be used to enhance the appearance of the post assembly of the invention. For example, the post assembly may include an adjustable trim ring assembly such as that described in U.S. Pat. No. 7,243,473, the contents of which are incorporated by reference.

Figure 40:
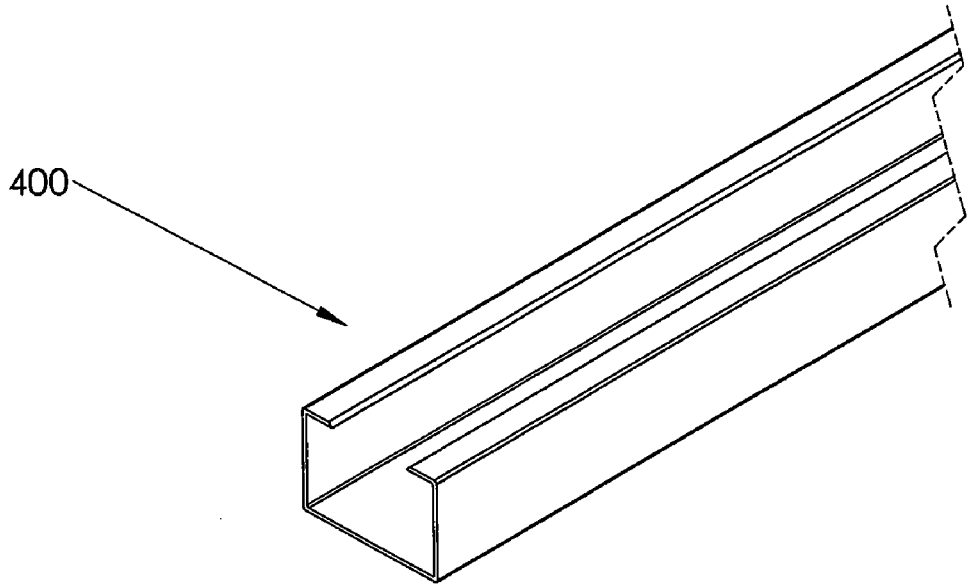
FIG. 40 is a truncated perspective view of a first reinforcement member for use in accordance with an exemplary embodiment of the invention.
Figure 41:
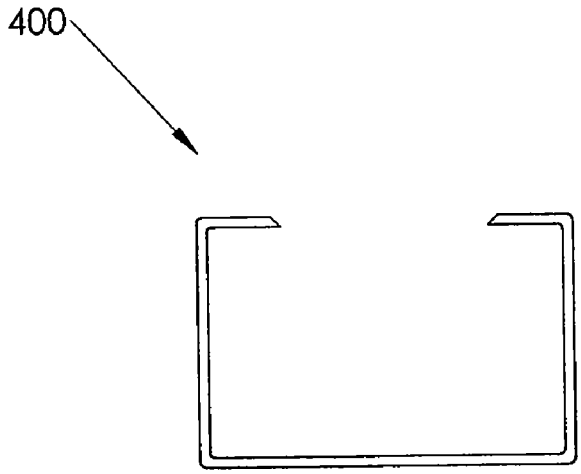
FIG. 41 is an end view of the first reinforcement member of FIG. 40.

FIGS. 40 and 41 illustrate a first exemplary aluminum extrusion 400 for insertion into the interior of a hollow railing, such as bottom railing 50 in FIG. 14, to reinforce the railing.

Figure 42:
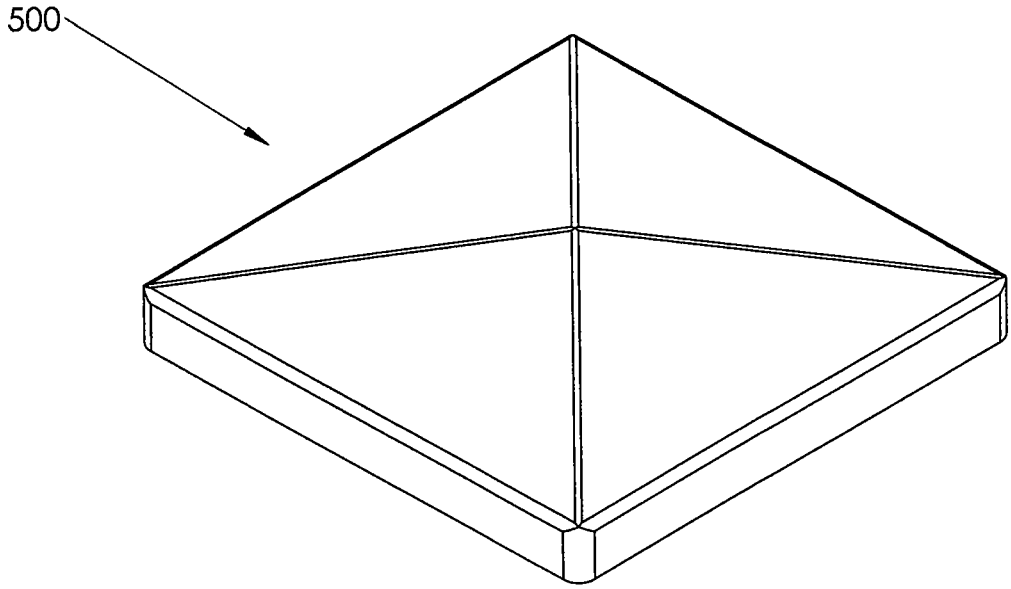
FIG. 42 is a perspective view of a first cap component in accordance with an exemplary embodiment of the invention.
Figure 43:
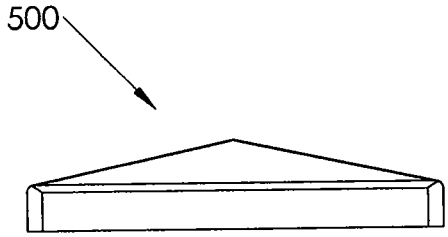
FIG. 43 is a front view of the cap component of FIG. 42.
Figure 44:
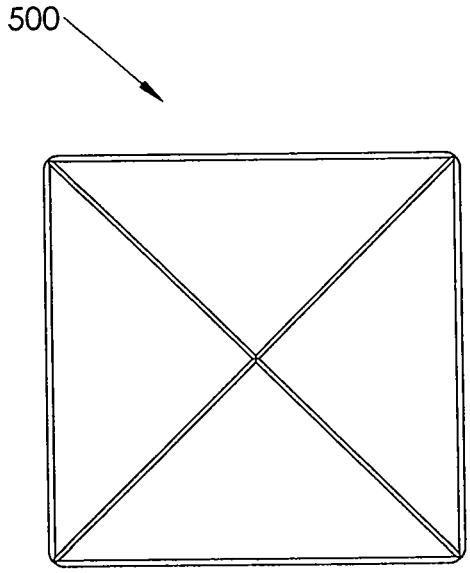
FIG. 44 is a top view of the cap component of FIG. 42.
Figure 45:
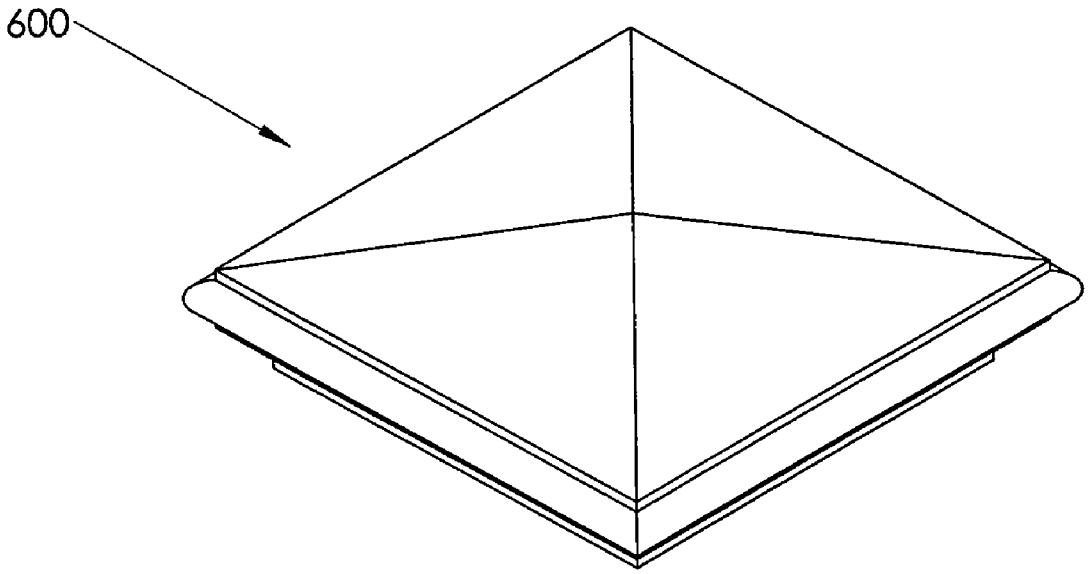
FIG. 45 is a perspective view of a second cap component in accordance with an exemplary embodiment of the invention.
Figure 46:
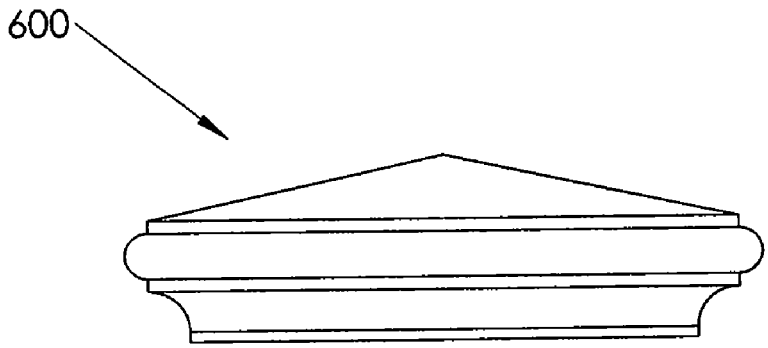
FIG. 46 is a front view of the cap component of FIG. 45.

FIGS. 42-44 illustrate a first exemplary post cap embodiment 500 for use on a post assembly in accordance with the present invention. FIGS. 45 and 46 illustrate a second exemplary post cap embodiment 600 for use on a post assembly in accordance with the present invention.

Figure 47:
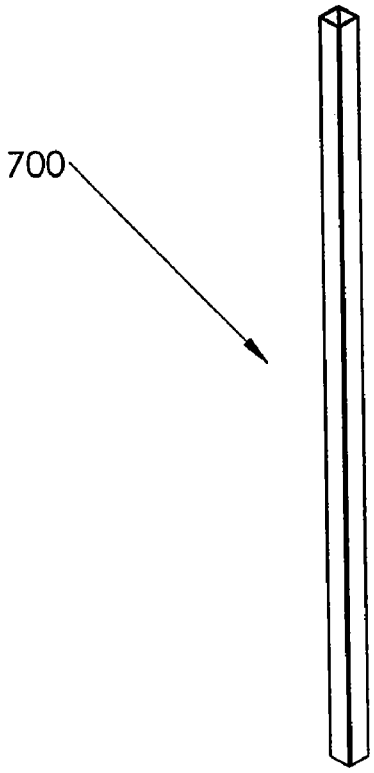
FIG. 47 is a perspective view of a baluster component in accordance with an exemplary embodiment of the invention.
Figure 48:
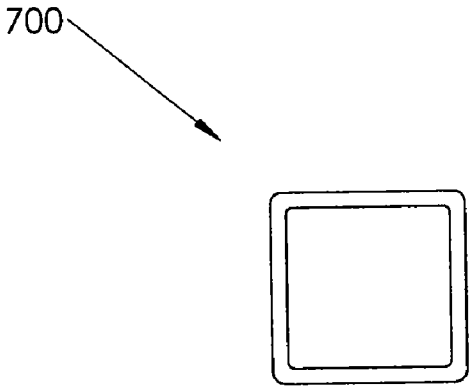
FIG. 48 is an end view of the baluster component of FIG. 47.

FIGS. 47 and 48 illustrate an exemplary square picket 700 for use on a post and rail assembly in accordance with the present invention.

Figure 49:
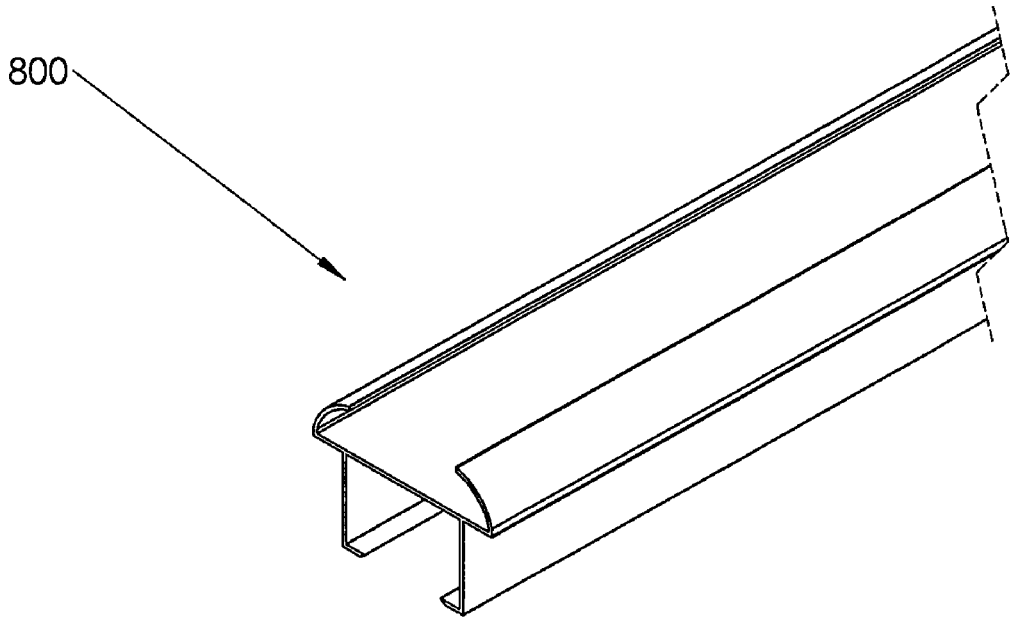
FIG. 49 is a truncated perspective view of a second reinforcement component in accordance with an exemplary embodiment of the invention.
Figure 50:
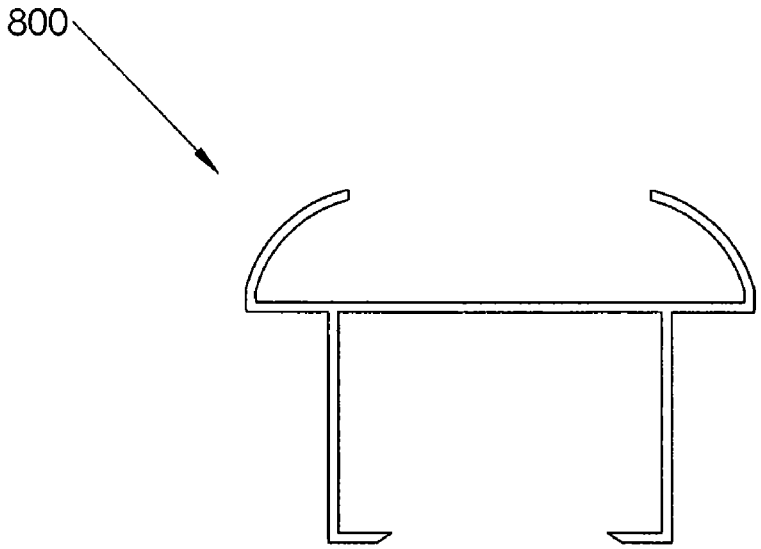
FIG. 50 is an end view of the reinforcement component of FIG. 49.

FIGS. 49 and 50 illustrate a second exemplary aluminum extrusion 800 for insertion into the interior of a hollow railing, such as top railing 40 in FIG. 12, to reinforce the railing.

In accordance with one aspect of the invention, the assembly advantageously provides a pre-assembled post that can be manufactured, sold, distributed and purchased as a packaged kit. In one possible kit, the kit may include a 3"×3" structural steel post with welded bottom flange (36" or 42" length), a 3.25"×3.25" vinyl post sleeve (37.5" or 43.5" length), and a pair of level brackets that are pre-mounted on the sleeve.

In another possible kit, two top level bracket covers, two bottom level bracket covers, one top PVC rail, one bottom PVC rail, one top aluminum support extrusion, one bottom aluminum support extrusion, pickets and fasteners for assembly will be packaged together.

A method for installing the above-described kit in accordance with the invention may include the following steps. The pre-assembled posts are installed onto the surface of the deck or porch using bolts through the holes in the bottom flange of the support post. Both top and bottom rails and rail supports are then cut to length and the pickets inserted into the pre routed holes. The rails and pickets, as a unit, are then inserted between the posts onto the already positioned brackets. The rails are fastened to the brackets with screws through the holes on each side of the brackets. The bracket covers are then pulled over the rail at the bracket and pressed up into the underside of the brackets, engaging a compression fit.

In another possible kit, two top stair bracket covers, two bottom stair bracket covers, one top PVC rail, one bottom PVC rail, one top aluminum support extrusion, one bottom aluminum support extrusion, pickets and fasteners for assembly will be packaged together.

A method for installing the above-described kit in accordance with the invention may include the following steps. The pre-assembled posts are installed onto the surface of the deck or porch at the top and bottom of the stairs or inclined surface using bolts through the holes in the bottom flange of the support post. The brackets are then installed onto the posts. The two top stair brackets are installed onto the post at the top of the stairs with the bottom brackets attaching to the post at the base of the stairs. Both top and bottom rails and rail supports are then cut to length at the proper angle and the pickets are inserted into the pre routed holes. The rails and pickets, as a unit, are then inserted between the posts onto the already positioned brackets. The rails are fastened to the brackets with screws through the holes on each side of the brackets. The bracket covers are then cut to match the rail angle to ensure a clean joint at the post. The bracket covers are then pulled over the rail at the bracket and pressed up into the underside of the brackets, engaging the compression fit.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A railing mounting assembly for mounting the end of a railing to a post structure, the railing mounting assembly comprising:

a U-shaped bracket having a pair of sidewalls and a bottom wall, the bottom wall comprising a pair of platform portions for supporting a railing, and a pair of recessed portions that are offset from the platform portions so as to form a cavity in the bracket, the recessed portions being separated from one another by a channel having a longitudinal axis; and a trim cover attached around the bracket, the trim cover having a ring-shaped wall surrounding a central opening, the wall comprising a slit and at least one locking member projecting through the channel of the U-shaped bracket into the cavity, wherein the locking member of the trim cover comprises a series of parallel ribs, and the channel comprises a flange in locked engagement with one of the parallel ribs, and wherein the locking member is adapted to engage and compress against the bottom of a railing when the railing is supported by the bracket.

2. The railing mounting assembly of claim 1, wherein the trim cover comprises a plurality of spacer bars projecting from the ring-shaped wall into the central opening.

3. The railing mounting assembly of claim 1, wherein the channel comprises a longitudinal axis, and wherein the bracket comprises a stop extending into the channel generally perpendicular to the longitudinal axis of the channel to prevent the at least one locking member of the trim cover from moving out of the channel.

4. The railing mounting assembly of claim 1, wherein the bracket comprises a fastener hole through one of the sidewalls.

5. The railing mounting assembly of claim 1, comprising a post structure, the bracket being mounted to the post structure.

6. The railing mounting assembly of claim 1, wherein the sidewalls include curved sections collectively forming a cradle with the bottom wall.

7. The railing mounting assembly of claim 1, wherein the bracket and the trim cover are coupled together solely by a snap connection.

8. A railing mounting assembly for mounting the end of a railing to a post structure, the railing mounting assembly comprising:

a U-shaped bracket having a pair of sidewalls and a bottom wall, the bottom wall comprising a pair of platform portions for supporting a railing, and a pair of recessed portions that are offset from the platform portions so as to form a cavity in the bracket, the recessed portions being separated from one another by a channel having a longitudinal axis; and a trim cover attached around the bracket, the trim cover having a ring-shaped wall surrounding a central opening, the wall comprising a slit and at least one locking member projecting through the channel of the U-shaped bracket into the cavity, wherein the locking member comprises a bar that extends substantially parallel to the channel, the bar comprising a top surface adapted to engage and compress against the bottom of a railing when the railing is supported by the bracket.

9. A railing mounting assembly for mounting the end of a railing to a post structure, the railing mounting assembly comprising:

a U-shaped bracket having a pair of sidewalls and a bottom wall, the bottom wall comprising a pair of platform portions for supporting a railing, and a pair of recessed portions that are offset from the platform portions so as to form a cavity in the bracket, the recessed portions being separated from one another by a channel having a longitudinal axis; and a trim cover attached around the bracket, the trim cover having a ring-shaped wall surrounding a central opening, the wall comprising a slit and at least one locking member projecting through the channel of the U-shaped bracket into the cavity, wherein the locking member comprises a pair of bars that extend substantially parallel to the channel, one of the bars extending on one side of the slit, and the other of the bars extending on the opposite side of the slit, and wherein the locking member is adapted to engage and compress against the bottom of a railing when the railing is supported by the bracket.

10. A railing mounting assembly for mounting the end of a railing to a post structure, the railing mounting assembly comprising:

a U-shaped bracket having a pair of sidewalls and a bottom wall, the bottom wall comprising a pair of platform portions for supporting a railing, and a pair of recessed portions that are offset from the platform portions so as to form a cavity in the bracket, the recessed portions being separated from one another by a channel having a longitudinal axis; and a trim cover attached around the brackets the trim cover having a ring-shaped wall surrounding a central opening, the wall comprising a slit and at least one locking member projecting through the channel of the U-shaped bracket into the cavity, wherein the bracket comprises a series of ratchet teeth along the channel that engage the locking member on the trim cover, the ratchet teeth permitting insertion of the locking member into the channel in a first direction and substantially preventing removal of the locking member from the channel in a second direction opposite the first direction, and wherein the locking member is adapted to engage and compress against the bottom of a railing when the railing is supported by the bracket.

* * * * *

UNITED STATES PATENT AND TRADEMARK OFFICE

CERTIFICATE OF CORRECTION

PATENT NO. : 7,731,160 B2
APPLICATION NO. : 12/236790
DATED : June 8, 2010
INVENTOR(S) : Christopher J. Terrels, Christopher Michael Schneider and Jason Michael Werner It is certified that error appears in the above-identified patent and that said Letters Patent is hereby corrected as shown below:

Title Page:

Item (75) Inventors: --Christopher Michael Schnieder--
Should Read

--Christopher Michael Schneider--

Signed and Sealed this

Seventeenth Day of August, 2010

David J. Kappos

David J. Kappos
*Director of the United States Patent and Trademark Office*